United States Patent [19]

Oates

[11] Patent Number: 4,613,994

[45] Date of Patent: Sep. 30, 1986

[54] COLLAPSIBLE PORTABLE ENEMA SEAT

[76] Inventor: Otto G. Oates, 106 Glen Springs Drive, Scarborough, Ontario, Canada, M1W 1X8

[21] Appl. No.: 739,151

[22] Filed: May 30, 1985

[51] Int. Cl.[4] ..... A47K 11/06

[52] U.S. Cl. ..... 4/480; 297/DIG. 4; 280/289 WC

[58] Field of Search ..... 4/480, 483, 478, 254; 297/DIG. 4; 280/289 WC, 242 WC

[56] References Cited

U.S. PATENT DOCUMENTS

| | | | |
|---|---|---|---|
| D. 265,119 | 6/1982 | Hurley . | |
| 3,341,864 | 7/1967 | Wichmann | 4/480 |
| 3,360,297 | 12/1967 | Oja et al. | 4/480 |
| 3,441,960 | 5/1969 | Norton | 4/578 |
| 3,512,187 | 5/1970 | Thomas et al. | 4/254 |
| 3,611,457 | 10/1971 | Wippich | 4/480 |
| 3,848,883 | 11/1974 | Breacain | 280/242 WC |
| 3,854,773 | 12/1974 | Thomas | 4/254 |
| 3,968,991 | 7/1976 | Maclaren | 280/242 WC |
| 4,052,087 | 10/1977 | Gagliardi | 4/483 |
| 4,177,528 | 12/1979 | James | 4/254 |
| 4,266,305 | 5/1981 | Kavoloski et al. | 297/DIG. 4 |
| 4,287,619 | 9/1981 | Brewer et al. | 297/DIG. 4 |
| 4,296,506 | 10/1981 | Stoute, Sr. et al. | 4/478 |
| 4,323,133 | 4/1982 | Williams | 280/242 WC |
| 4,334,330 | 6/1982 | Marshall | 4/480 |
| 4,428,615 | 1/1984 | Hynson | 4/483 |
| 4,431,206 | 2/1984 | Pryor | 297/DIG. 4 |
| 4,510,631 | 4/1985 | Grady | 4/478 |
| 4,514,867 | 5/1985 | Jensen | 4/480 |

FOREIGN PATENT DOCUMENTS 1429347 2/1969 Fed. Rep. of Germany ... 297/DIG. 4

*Primary Examiner*—Stephen Marcus
*Assistant Examiner*—Leo James Peters
*Attorney, Agent, or Firm*—Ivor M. Hughes

[57] ABSTRACT

A portable enema seat is provided, comprising a base, foldable support secured at one end of the base, and a foldable seat supported by the base and positioned from the foldable support to create a space in which the user can easily access or egress the seat. The seat has a downwardly directed opening therethrough, said seat being discontinuous at a central rearward position remote the pivotable support. The foldable support secures the user of the enema seat when the user is leaning on or against it. A waste receptacle support is also provided to sustain a waste receptacle below the downwardly directed opening. A pair of arms is pivotally secured to the foldable support (one arm on each side) and which arms are each pivotable laterally, one at a time from positions securing the seat to the support, (thereby rigidifying the structure), to a position laterally away from one side of the seat to permit the paraplegic to enter the space between the support and seat by grasping the opposite secured arm, and the foldable front support or seat for supporting and pulling himself-/herself onto the seat. Thereafter, the pivoted arm is moved to a position securing the support to the seat.

16 Claims, 10 Drawing Figures

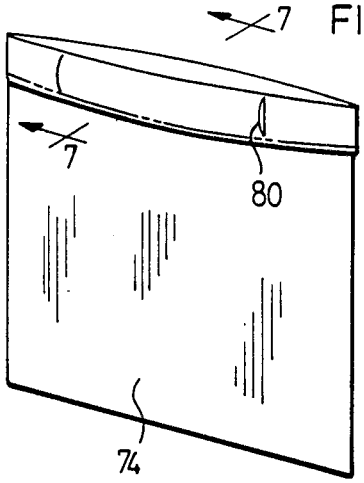
FIG. 6.
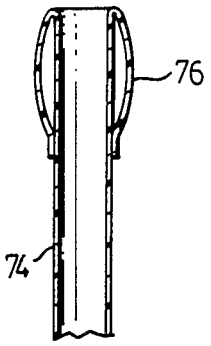
FIG. 7.
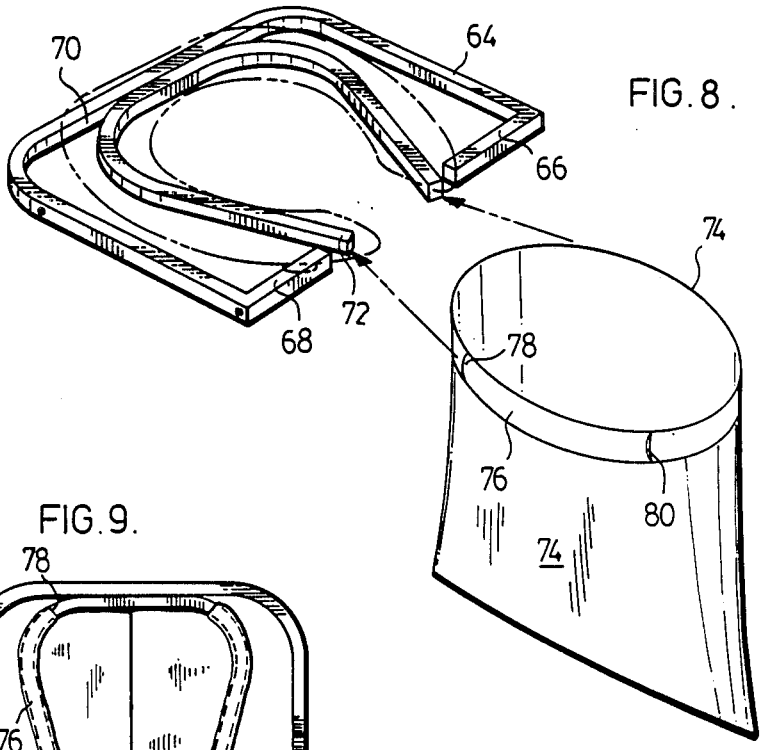
FIG. 8.
FIG. 9.
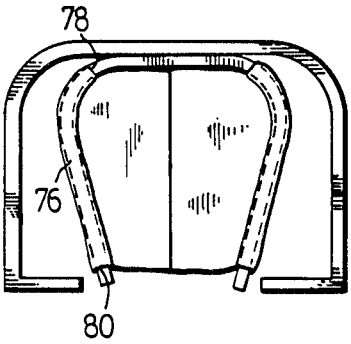

COLLAPSIBLE PORTABLE ENEMA SEAT

FIELD OF INVENTION

This invention relates to a collapsible portable enema seat.

BACKGROUND OF INVENTION

Because some paraplegics have no muscle control of the anus, they are incapable of having regular bowel movements and must, as a result, be given regular enemas every few days. Unless the paraplegic is able to administer the enema himself/herself, or is attended by someone skilled in giving enemas, he/she must attend regularly at for example, a hospital for the administration of an enema—an inconvenient necessity. When attending at for example, the paraplegic's olympics, these paraplegics because of their number, must literally make an appointment at the local hospital for their enemas.

It is therefore, an object of this invention to provide a portable enema seat, which is easily folded for travel and easily unfolded for use at the paraplegic's destination for the administration of an enema by the paraplegic himself/herself, or by a third party to the paraplegic.

Because paraplegics suffer from muscle spasms, any enema seat must be securely held together and stable, otherwise during one of such spasms, the enema seat could be so shaken that it may collapse.

It is therefore an object of this invention to provide a portable enema seat which is entirely stable, rigid and secure when unfolded for use.

Further and other objects of the invention will be realized by those skilled in the art from the following summary of the invention and detailed description of a preferred embodiment thereof.

SUMMARY OF THE INVENTION

According to one aspect of the invention, a portable enema seat is disclosed, the enema seat comprising; a rigid base to extend in use substantially horizontally; a pivotable support secured at one end of the base to extend upright in one position, and pivotable from the upright position to a folded lowered position on the base; and having integrally connected thereto a support for supporting the user of the enema seat when leaning on or against the support when upright a seat supported by the base spaced from the pivotable support, to create a space in which the user can easily access or egress the seat, the seat being pivotable from an upstanding position in use to a position abutting the base and parallel to the base, the seat having a downwardly directed opening therethrough and said seat being discontinuous at a central rearward position remote the pivotable support; means to support a waste receptacle (for example, a disposable polyethylene bag) below the downwardly directed opening of the seat; and a pair of arms secured to the pivotable support, one on either side, each arm pivotable laterally one at a time; from a position securing the seat to the support (thereby rigidifying the structure) to a position laterally away from the side of the seat to permit the paraplegic to enter the space between the pivotable support and seat by grasping the opposite secured arm and or the support or seat for support and pulling himself/herself onto the seat, thereafter resecuring the arm and outrigger means carried in the base of the enema seat thereby stabilizing the entire structure from tipping when in use.

According to another aspect of the invention, a detachable seat may be removeably secured to the base at the end of the base remote the pivotable support and spaced from the seat having the downwardly directed opening therethrough.

According to another aspect of the invention, outrigger supports may be carried in the base (for example, to be telescoped laterally from the base) for added stability.

According to another aspect of the invention, the seat may carry a back for precluding the paraplegic falling backwards.

According to another aspect of the invention, a pole for carrying fluid (for example, bags of fluid) is secured to the base.

According to another aspect of the invention the pivotable support carries a padded U-shaped handle and said handle may be adjusted to a number of predefined positions (while pivoting on the pivotable support) by moving said handle atop the pivotable support towards and away from the seat thereby allowing the user the individual choice of handle position.

According to another aspect of the invention, a foot plate may be provided below the support secured to the base for carrying the feet of the paraplegic when sitting on the seat.

BRIEF DESCRIPTION OF THE DRAWINGS

The invention will now be illustrated with reference to the following drawings of embodiments of the invention in which:

FIG. 6 is a perspective view of a bag receptacle for use with the enema seat.

FIG. 7 is a cross-sectional view of the bag receptacle in FIG. 6.

FIG. 8 is a perspective exploded view of part of the seat of FIG. 1 and the bag receptacle.

FIG. 9 is a top view of the bag receptacle carried by the seat shown in FIG. 8.

DETAILED DESCRIPTION OF PREFERRED EMBODIMENTS OF THE INVENTION

Figure 1:
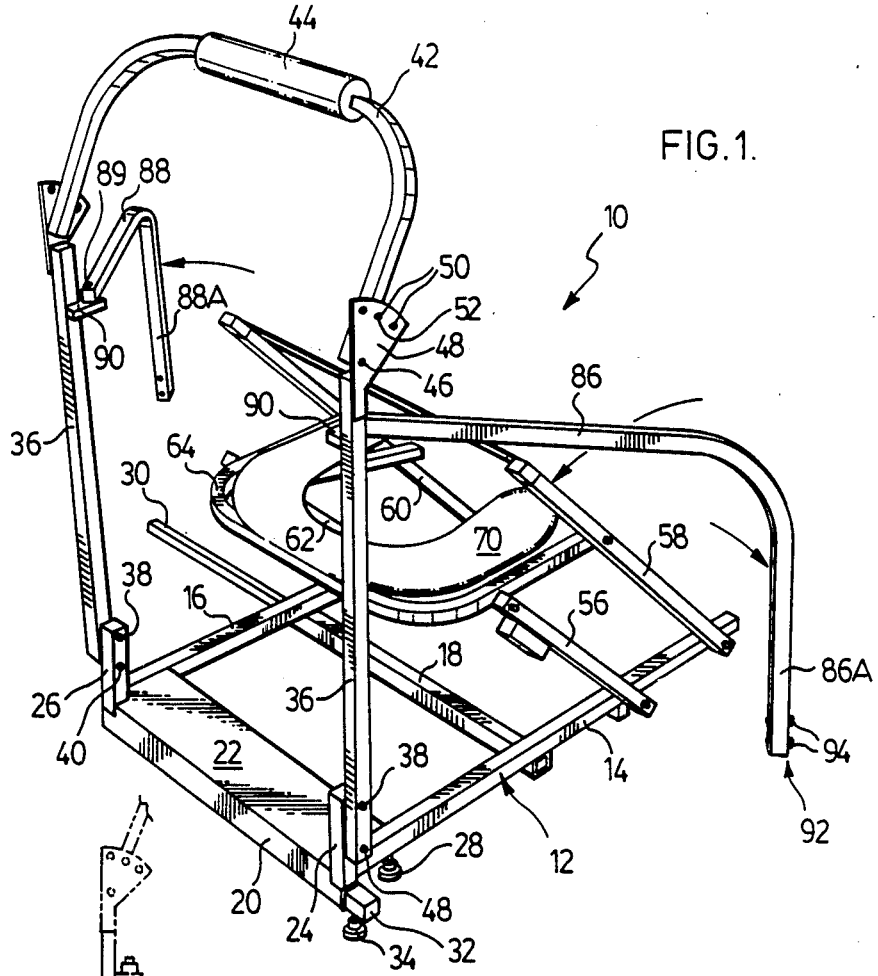
FIG. 1 is a perspective view of a partially folded enema seat according to an embodiment of the invention.
Figure 2:
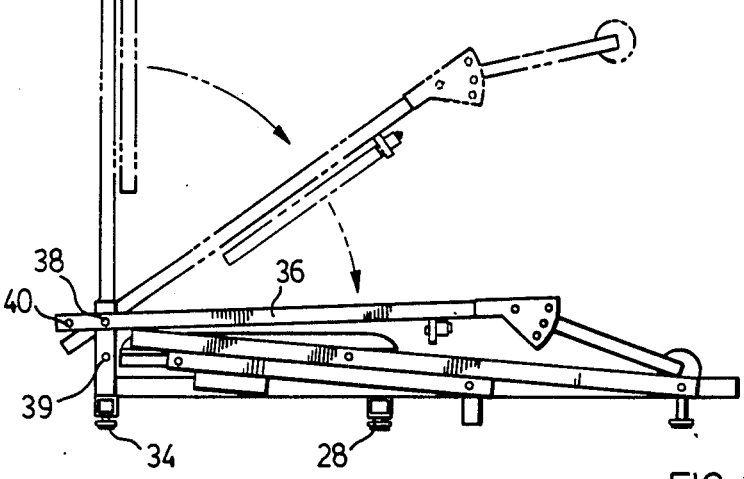
FIG. 2 is a side view of the enema seat of FIG. 1 in a folded position.
Figure 3:
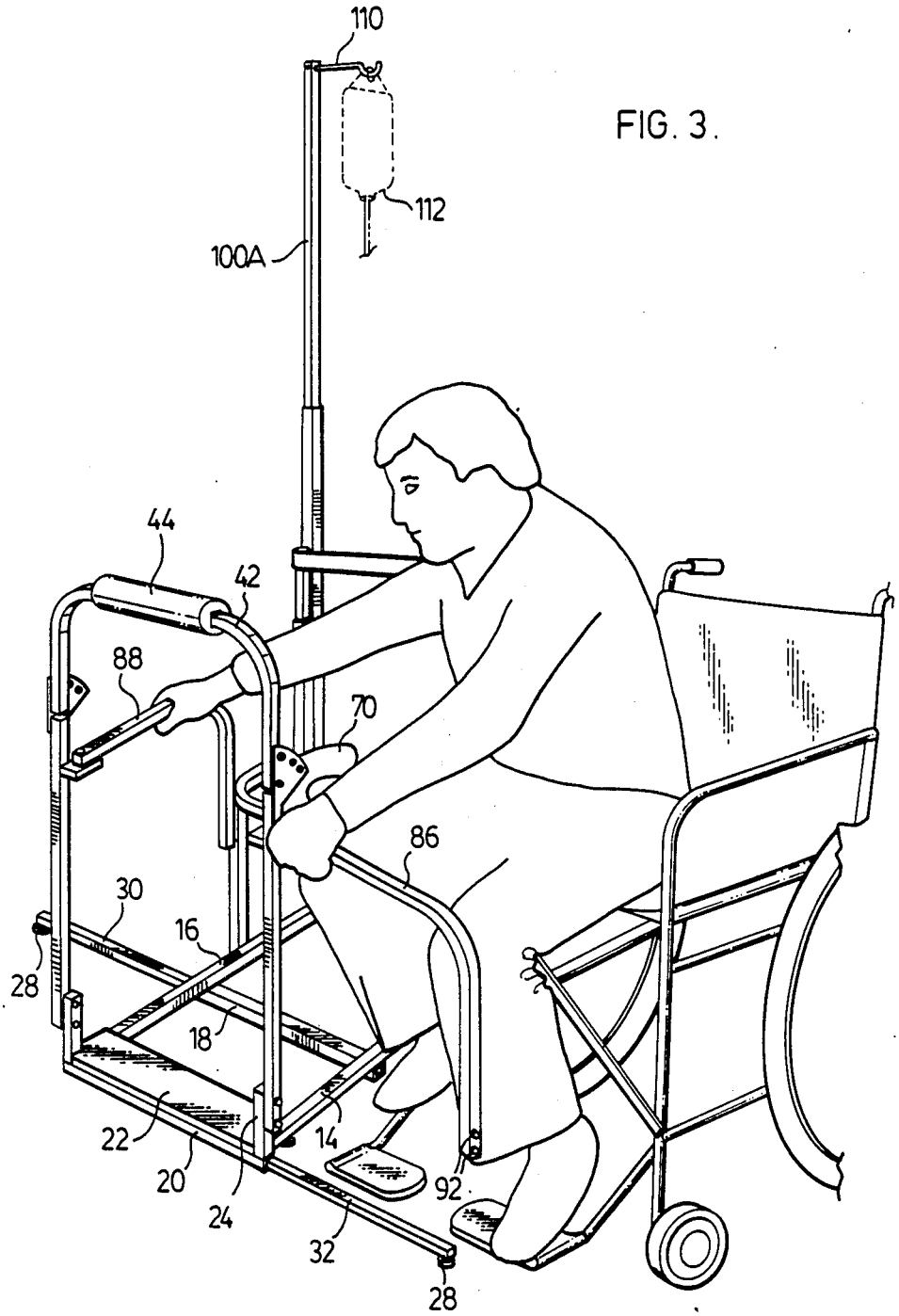
FIGS. 3, 4 and 5 are perspective views of the embodiment shown in FIG. 1 erected for use as shown.
Figure 4:
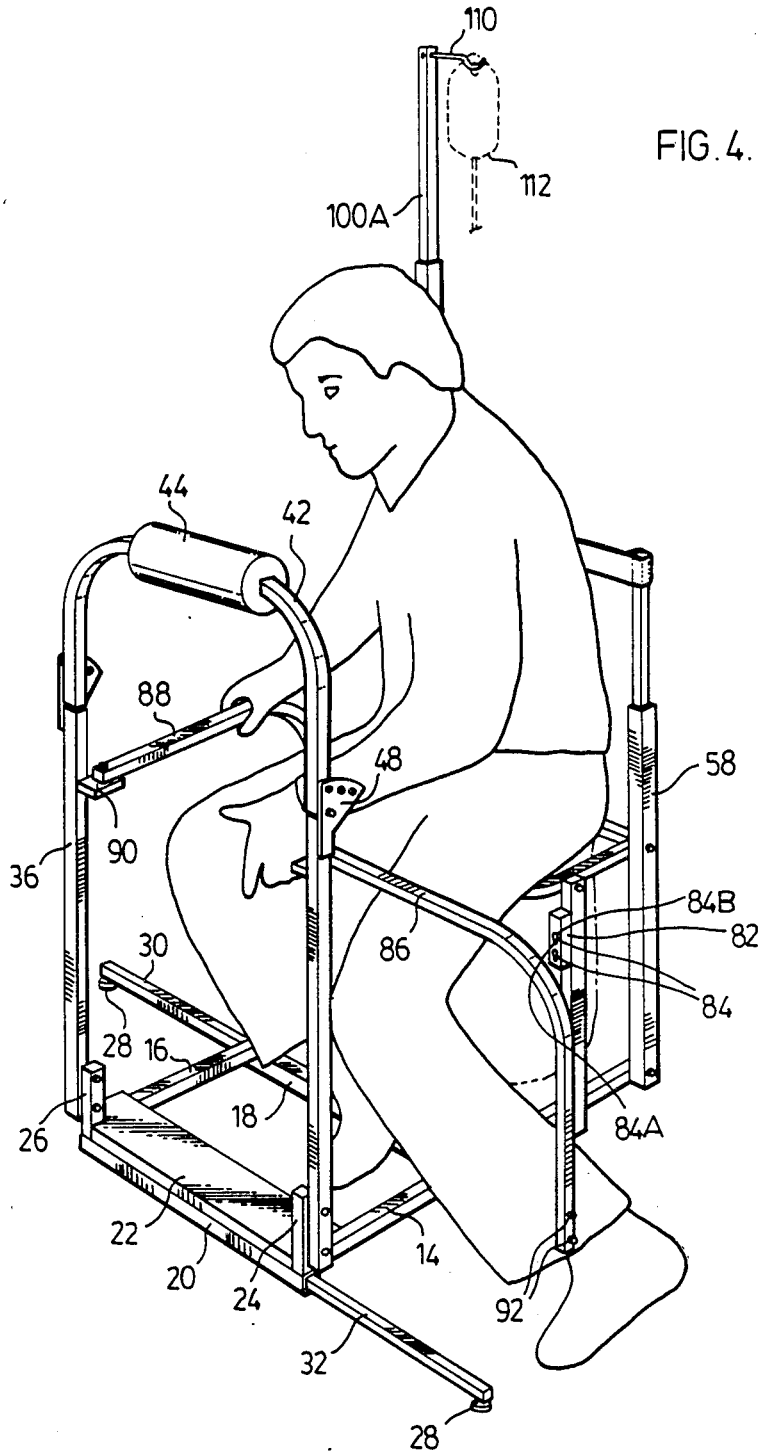
Figure 5:
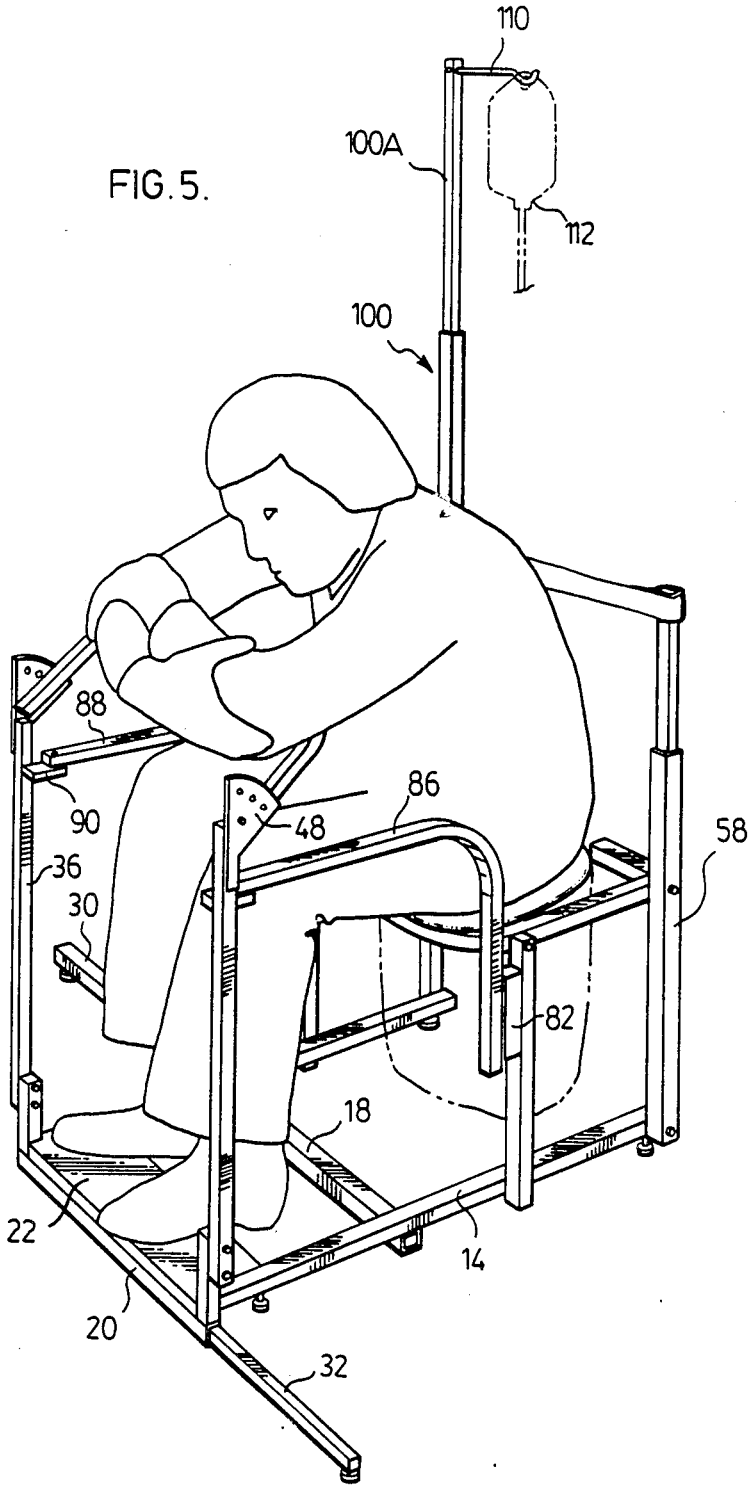
Figure 10:
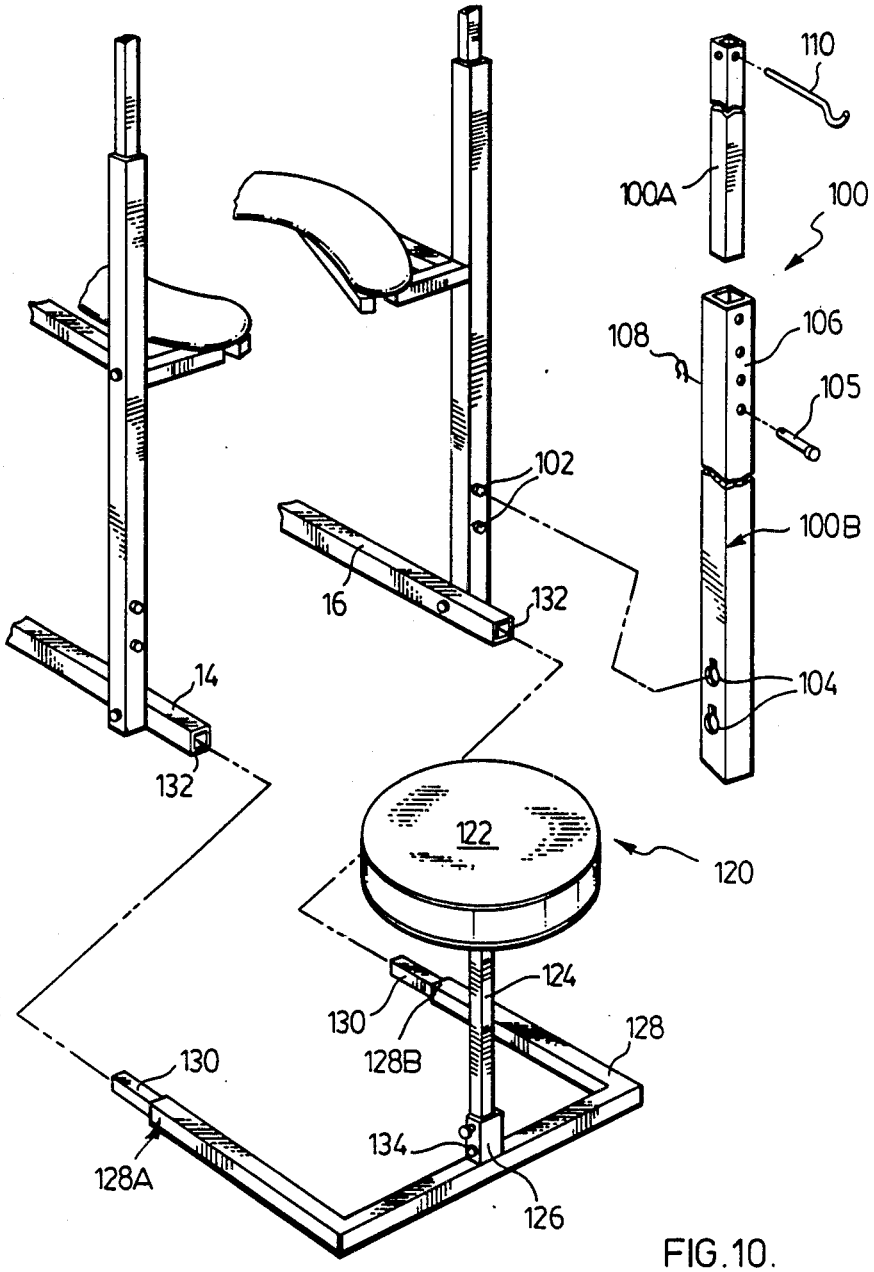
FIG. 10 is a perspective exploded view of part of the enema seat of FIG. 1 with additional components secured thereto.

With reference to FIGS. 1 to 5 inclusive, enema seat 10 includes rigid base 12, comprising tubular frame members 14 and 16. Each member 14 and 16 is of a square cross-section and carries cross members 18 and 20 also of square cross-section and each being hollow, member 20 securing the ends of members 14 and 16 at one end and member 18 connecting members 14 and 16 intermediate their ends. Carried on cross-member 20 and secured to each of members 14 and 16 is foot plate 22. Feet 28 are carried on the underside of members 14, 16 and 20 for supporting base 12. Outriggers 30 and 32 are telescopically slideable in members 18 and 20 respectively from a stored position (see FIG. 1) to an extended position (see FIGS. 3, 4 and 5) for supporting the base. The end of each outrigger 30 and 32 carries a foot 34 for support. Upstanding supports 24 and 26 are carried at the union of members 14 and 20, and 16 and 20 respectively. Each support 24 or 26 is secured to an upstanding frame member or pivotable support 36. Pin 38 passing through each of support 24 or 26 and member 36 permits member 36 to pivot with respect to members 24 or 26 from an upright position to a position on base 12 (see FIG. 2). Member 36 caries an aperture therethrough below pin 38 for receiving retractable pin 40 for assisting to maintain member 36 upright when said pin is secured into aperture 39 on supports 24 or 26. U-shaped handle 42 carrying intermediate cover portion 44 is pivotally secured by pins 46 at both ends connecting to arced portions 48 on the upper end of members 36. Three circumferentially disposed apertures 50 are provided near the upper end of both portions 48 for receiving spring-loaded pins 52 secured in arced portions 48 which lock into coinciding apertures in each end of U-shaped member 42. Each of the apertures 50 on arced portions 48 may be fastened in like manner to U-shaped member 42 to provide optimum security. Pivotably secured upstanding frame members 56 and 58, and 60 and 62 are secured to members 14 and 16 respectively and support U-shaped frame member 64 at the top thereof (see also FIG. 8) carrying inwardly directed arms 66 and 68. Support 64 carries a U-shaped seat opening in a direction away from handle 42. Welded below seat 70 is bag carrier 72 which is U-shaped for receivinb plastic disposal bag 74 carrying folded-over cuff 76 sealed to the side of bag 74. Vertical slits 78 and 80 are provided on both sides of the cuff for permitting each bag 74 to be carried by a U-shaped bag carrier with support arms 72 inserted through slit 78 into the space between cuff 76 and the outer surface of bag 74 exiting from the space from slit 80 (see FIG. 9).

On the side of each member 56 and 62 closest members 36, each member 56 and 62 carries a lock structure 82 (see FIG. 4), carrying a pair of vertically spaced key lock openings 84, carrying lower narrower portion 84A and wider portions 84B facing members 36. For securing members 36 to members 56, 58, 60 and 62, carrying seat 70, arms 86 and 88 are laterally pivotally secured to members 36 by pins 89 pivotally secured to supports 90. On the downwardly extending arm portions 86A and 88A are vertically spaced circular pins 92 carrying heads 94 spaced from the surface of each of arm portions 86A or 88A (see FIG. 1). Pins 92 are locked in openings 84A of locks 82 by pushing heads 94 through apertures 84B into the narrow portions 84A. Therefore, pins 92 are spaced by a distance equal to the distance portions 84B are spaced. When arms 86 and 88 are secured by pins 92 to members 56 and 62, the structure is in its erect position and is rigidified by the connection. For folding the structure, upon removal of pin 143 from apertures 140 and 141 in members 56 and 142, respectively, and disconnecting clip 144. (FIG. 1) arms 86 and 88 can be disconnected from members 56 and 62 permitting members 56, 58, 60 and 62 to be pivoted towards members 36 (see FIG. 2), arms 86 and 88 folded across one another and members 36 pivoted downwardly after pins 40 have been retracted from apertures 39. For erection for use the procedure is reversed. As is shown, members 58 and 60 are longer than members 56 and 62 and carry a seat back support therebetween. For use the portable enema seat is erected and the outriggers 30 and 32 extended for support. Thereafter, the user moves up to one of arms 86 or 88 (in FIG. 3, arm 86) lifts the arm (86) and with the right hand on opposite arm 88 and the left arm on either arm 86 proximate support 90 or U-shaped member 42, or seat frame 64, pulls himself into the space between the arms 86 and 88 onto seat 70 (see FIG. 4). The user then secures arm 86, positions himself leaning forward on arm 42 (as adjusted), places his feet on foot plate 22 and is ready for the administration of the enema. In this regard, member 60 carries upstanding pole 100 secured by pin 102 in key lock arrangement 104. Pole 100 comprises telescoping member 100A which telescopes in member 100B and is supported on pin 104 adjustable through apertures 106 through opposed sides of member 100B by clip 108. Member 100A carries arm 110 for carrying water bag 112, carrying tubing 114 for administering an enema.

Seat 120 is provided for removeably securing to base 12 on the side of seat 70 remote members 36 for use by a third person when administering an enema to the paraplegic. In this regard, seat 120 comprises padded seat top 122, support 124 secured to vertically extending holder support 126 carried on U-shaped base 128 comprising hollow tubular members (square in cross-section) opening at its ends 128A and 128B for receiving members 130 for securing in the open ends 132 of members 14 and 16. Support 126 carries pin 134 pivotally securing support member 126 to support 124 and retractable pin 136 for rigidly securing (with pin 134) support 124 in a vertical position by extending into an aperture (not shown) in support 124. To permit member 124 to pivot the side of support 126 facing seat 70 is removed.

As many changes can be made to the construction of the embodiment without departing from the scope of the invention, it is intended that all matter contained herein be interpreted as illustrative of the invention and not in a limiting sense.

The embodiments of the invention in which an exclusive privilege or property is claimed are as follows:

1. A portable enema seat comprising; a rigid base to extend in use substantially horizontally; a pivotable support secured at one end of the base to extend upright when in use and pivotable from the upright position to a folded lowered position on the base, having integrally connected thereto a support for sustaining the user of the enema seat when leaning on or against the pivotable support when upright; a seat supported by the base spaced from the pivotable support, the seat being pivotable from an upstanding position in use, to a position lying above the base and parallel to the base, the seat having a downwardly directed opening therethrough and said seat being discontinuous at a central rearward position remote the pivotable support; means to support a receptacle below the downwardly directed opening of the seat and a pair of arms secured to the pivotable support, one on each side of the seat, each arm pivotable laterally one at a time from a position securing the seat to the support, thereby rigidifying the structure, to a position laterally away from the side of the seat to permit the user to enter the space between the support and seat by grasping the opposite secured arm and or the support or seat for support and pulling himself/herself onto the seat; and outrigger means carried in the base of the enema seat thereby stabilizing the entire structure from tipping when in use.

2. The portable enema seat of claim 1, wherein the outrigger means carried in the base are telescoped laterally from the base for added stability.

3. The portable enema seat of claim 1, wherein the seat carries a back for precluding the paraplegic falling backwards.

4. The portable enema seat of claim 2, wherein the seat carries a back for precluding the paraplegic falling backwards.

5. The portable enema seat of claim 1, wherein a pole for carrying fluid is secured to the base.

6. The portable enema seat of claim 2, wherein a pole for carrying fluid is secured to the base.

7. The portable enema seat of claim 3, wherein a pole for carrying fluid is secured to the base.

8. The portable enema seat of claim 4, wherein a pole for carrying fluid is secured to the base.

9. The portable enema seat of claim 1, wherein the support carries a pivotable handle pivotable with respect to the support and said handle is pivotably securable to the support at a number of predefined positions to move the handle of the support away from or towards the seat, thereby allowing the user the individual choice of handle position.

10. The portable enema seat of claim 2, wherein the support carries a pivotable handle pivotable with respect to the support and said handle is pivotably securable to the support at a number of predefined positions to move the handle of the support away from or towards the seat, thereby allowing the user the individual choice of handle position.

11. The portable enema seat of claim 3, wherein the support carries a pivotable handle pivotable with respect to the support and said handle is pivotably securable to the support at a number of predefined positions to move the handle of the support away from or towards the seat, thereby allowing the user the individual choice of handle position.

12. The portable enema seat of claim 4, wherein the support carries a pivotable handle pivotable with respect to the support and said handle is pivotably securable to the support at a number of predefined positions to move the handle of the support away from or towards the seat, thereby allowing the user the individual choice of handle position.

13. The portable enema seat of claim 1, further comprising a foot plate below the support secured to the base for carrying the feet of the paraplegic when sitting on the seat.

14. The portable enema seat of claim 2, further comprising a foot plate below the support secured to the base for carrying the feet of the paraplegic when sitting on the seat.

15. The portable enema seat of claim 3, further comprising a foot plate below the support secured to the base for carrying the feet of the paraplegic when sitting on the seat.

16. The portable enema seat of claim 4, further comprising a foot plate below the support secured to the base for carrying the feet of the paraplegic when sitting on the seat.

* * * * *

UNITED STATES PATENT AND TRADEMARK OFFICE

CERTIFICATE OF CORRECTION

PATENT NO. : 4,613,994

DATED : September 30, 1986

INVENTOR(S) : Otto G. Oates

It is certified that error appears in the above-identified patent and that said Letters Patent is hereby corrected as shown below:

At column 3 of the patent, line 30 after 'for' and before 'plastic', the word "receivinb" has been replaced with ---receiving---.

Signed and Sealed this

Thirteenth Day of December, 1988

*Attest:*

DONALD J. QUIGG

*Attesting Officer*

*Commissioner of Patents and Trademarks*